US009551466B2

(12) United States Patent
Goldstein et al.

(10) Patent No.: US 9,551,466 B2
(45) Date of Patent: Jan. 24, 2017

(54) LED-BASED DIRECT-VIEW LUMINAIRE WITH UNIFORM MIXING OF LIGHT OUTPUT

(71) Applicant: KONINKLIJKE PHILIPS N.V., Eindhoven (NL)

(72) Inventors: Peter Isaac Goldstein, Medford, MA (US); Eric Anthony Roth, Tyngsboro, MA (US); Brian Roberge, Franklin, MA (US)

(73) Assignee: PHILIPS LIGHTING HOLDING B.V., Eindhoven (NL)

( * ) Notice: Subject to any disclaimer, the term of this patent is extended or adjusted under 35 U.S.C. 154(b) by 36 days.

(21) Appl. No.: 14/359,249

(22) PCT Filed: Nov. 16, 2012

(86) PCT No.: PCT/IB2012/056494

§ 371 (c)(1),
(2) Date: May 19, 2014

(87) PCT Pub. No.: WO2013/072885

PCT Pub. Date: May 23, 2013

(65) Prior Publication Data

US 2014/0321115 A1 Oct. 30, 2014

Related U.S. Application Data

(60) Provisional application No. 61/560,970, filed on Nov. 17, 2011.

(51) Int. Cl.
*F21V 9/00* (2015.01)
*F21K 99/00* (2016.01)
(Continued)

(52) U.S. Cl.
CPC ..... *F21K 9/54* (2013.01); *F21S 10/02* (2013.01); *F21V 7/0008* (2013.01);
(Continued)

(58) Field of Classification Search
CPC ..... F21K 9/54; F21S 10/02; F21V 7/0008; F21V 7/0041
See application file for complete search history.

(56) References Cited

U.S. PATENT DOCUMENTS 6,016,038 A 1/2000 Mueller et al.
6,211,626 B1 4/2001 Lys et al.
(Continued)

FOREIGN PATENT DOCUMENTS

DE 10349788 A1 5/2005
EP 2369224 A1 9/2011
(Continued)

*Primary Examiner* — Peggy Neils
*Assistant Examiner* — Alexander Garlen
(74) *Attorney, Agent, or Firm* — Meenakshy Chakravorty

(57) ABSTRACT

Methods and apparatus are provided for producing mixed light in a direct-view luminaire. The luminaire includes a plurality of light sources (132) that, in combination, are configured to generate a plurality of different colors of light, a first light mixing chamber (110) and at least one second light mixing chamber (120) in light communication with the first mixing chamber through at least one opening (134). At least one directly viewable light exit surface (112) is coupled to the first light mixing chamber. The light sources are contained in the second light mixing chamber(s), which is configured to prevent light emitted from the light sources from directly impinging on the light exit surface(s). The first light mixing chamber and the light exit surface(s) are configured to mix the light emitted from the light sources such that all light exiting the light exit surface(s) is substantially uniform in brightness and color.

19 Claims, 7 Drawing Sheets

(51) Int. Cl.

| | |
|---|---|
| ***F21S 10/02*** | (2006.01) |
| ***F21V 7/00*** | (2006.01) |
| *F21Y 105/00* | (2016.01) |
| *F21Y 101/00* | (2016.01) |

(52) U.S. Cl.

CPC ..... *F21V 7/0041* (2013.01); *F21K 9/62* (2016.08); *F21Y 2101/00* (2013.01); *F21Y 2105/00* (2013.01); *F21Y 2113/10* (2016.08); *F21Y 2115/10* (2016.08)

(56) References Cited

U.S. PATENT DOCUMENTS

| | | | | |
|---|---|---|---|---|
| 7,497,587 | B2 * | 3/2009 | Klose | F21S 8/026 362/147 |
| 7,806,556 | B2 * | 10/2010 | Wu | F21V 29/004 362/235 |
| 7,837,375 | B2 | 11/2010 | Watanabe et al. | |
| 2004/0233664 | A1 | 11/2004 | Beeson et al. | |
| 2005/0161586 | A1 | 7/2005 | Rains, Jr. et al. | |
| 2008/0291668 | A1 | 11/2008 | Aylward et al. | |
| 2008/0310158 | A1 * | 12/2008 | Harbers | F21K 9/54 362/240 |
| 2009/0116235 | A1 | 5/2009 | Tsao et al. | |
| 2009/0122227 | A1 | 5/2009 | Hong et al. | |
| 2009/0295266 | A1 * | 12/2009 | Ramer | F21K 9/00 313/113 |
| 2010/0027256 | A1 | 2/2010 | Kinoshita | |
| 2010/0172120 | A1 | 7/2010 | Wegh et al. | |
| 2010/0172152 | A1 * | 7/2010 | Boonekamp | F21V 7/0008 362/609 |

FOREIGN PATENT DOCUMENTS

| | | | |
|---|---|---|---|
| JP | 2009043636 | A | 2/2009 |
| WO | 2006003569 | A1 | 1/2006 |
| WO | 2008011723 | A2 | 1/2008 |
| WO | 2008050288 | A1 | 5/2008 |
| WO | 2008142638 | A1 | 11/2008 |
| WO | 2008146229 | A2 | 12/2008 |
| WO | 2009098797 | A1 | 8/2009 |
| WO | 2011025724 | A1 | 3/2011 |

* cited by examiner

LED-BASED DIRECT-VIEW LUMINAIRE WITH UNIFORM MIXING OF LIGHT OUTPUT

CROSS-REFERENCE TO PRIOR APPLICATIONS

This application is the U.S. National Phase application under 35 U.S.C. §371 of International Application No. PCT/IB2012/056494, filed on Nov. 16, 2012, which claims the benefit of [e.g., U.S. Provisional Patent Application No. or European Patent Application No.] 61/560,970, filed on Nov. 17, 0211. These applications are hereby incorporated by reference herein.

TECHNICAL FIELD

The present invention is directed generally to apparatus and methods of providing mixed light by LED light sources. More particularly, various inventive methods and apparatus disclosed herein relate to the generation of light that is substantially uniform in brightness and color from a color-mixing LED-based luminaire.

BACKGROUND

Digital lighting technologies, i.e., illumination based on semiconductor light sources, such as light-emitting diodes (LEDs), offer a viable alternative to traditional fluorescent, HID, and incandescent lamps. Functional advantages and benefits of LEDs include high energy conversion and optical efficiency, durability, lower operating costs, and many others. Recent advances in LED technology have provided efficient and robust full-spectrum lighting sources that enable a variety of lighting effects in many applications. Some of the fixtures embodying these sources feature a lighting module, including one or more LEDs capable of producing different colors, e.g. red, green, and blue, as well as a processor for independently controlling the output of the LEDs in order to generate a variety of colors and color-changing lighting effects, for example, as discussed in detail in U.S. Pat. Nos. 6,016,038 and 6,211,626, incorporated herein by reference.

In many lighting fixtures (or "luminaires") that embody one or more LEDs capable of producing light at particular color points and color temperatures, it may be desirable to appropriately mix the light output of such LEDs prior to the light output exiting the LED-based lighting fixture. Appropriate mixing of the LEDs may reduce the presence of any undesired chromatic nonuniformity in the light output of the lighting fixture and provide more desirable light output characteristics. In implementing mixing solutions, many lighting fixtures employ multiple large mixing chambers and/or only provide illumination from a single planar light exit opening. Such configurations may result in an undesirably large mixing solution and/or a mixing solution of limited utility.

Also, various techniques developed for mixing light from LED light sources in the far field, i.e., illuminating a distant surface with light having uniform brightness or color, do not satisfactorily address the color mixing, uniformity, or lit appearance of a direct-view luminaire. Specifically, one important characteristic of a direct-view luminaire is the uniform appearance of the surface that emits light. A uniform appearance is one in which there are no bright or dark areas or color variations in the light, such as greenish or pinkish spots. Preferably, an observer should not be able to distinguish individual light sources (or rows thereof) or discern individual colors (e.g., red, green, or blue) simply by looking at the luminaire.

Color uniformity is important because architects and lighting designers go to great lengths to obscure individual bright spots and color variations on luminaires for aesthetic appeal. For example, fixtures may be installed within a recess (or at a further distance from a wall) to hide scalloping effects and direct glare. The value of a product that creates uniform color on a wall is greatly diminished when the luminaire exhibits prominent color or brightness non-uniformities that have to be hidden using other techniques.

The discrete nature of color LED light sources used in luminaires makes it more difficult to provide a uniform brightness and color for direct-view LED-based luminaires. Prior approaches often employ additional hardware, for example, secondary lenses to try to achieve uniformity in appearance. However, these approaches do not provide a luminaire that has the desired light-output characteristics and aesthetic appeal.

Thus, there is a need in the art to provide an LED-based direct-view luminaire producing satisfactory mixing of light output from a plurality of LEDs, such that its light-emitting surface appears substantially uniform in brightness and color, without using secondary lenses or other techniques, and that may optionally overcome one or more drawbacks with existing mixing solutions.

SUMMARY

The present disclosure is directed to inventive methods and apparatus for producing mixed light in a direct-view luminaire that is substantially uniform in brightness and color. Applicants have recognized and appreciated that the uniformity of the light-emitting surface of a direct-view luminaire can be improved by employing a combination of mixing chambers. In one embodiment, a luminaire includes a plurality of light sources that, in combination, are configured to generate a plurality of different colors of light (e.g., using groups of different color LEDs). The luminaire further includes a first light mixing chamber and one or more second light mixing chambers in light communication with the first light mixing chamber. For example, one or more small light mixing chambers can be in light communication with a large light mixing chamber. In this example, at least one directly viewable light exit surface is coupled to the large light mixing chamber. The light sources are contained in the small light mixing chamber(s), which is configured to prevent light emitted from the light sources from directly impinging on the light exit surface(s). Light travels from the small light mixing chamber(s) through the opening(s) to illuminate the large light mixing chamber. The large light mixing chamber and the light exit surface(s) are configured to mix the light emitted from the light sources such that all light exiting the light exit surface(s) is substantially uniform in brightness and color.

Generally, in one aspect, a luminaire includes a plurality of light sources, that, in combination, are configured to generate a plurality of different colors of light, a first chamber configured to mix the plurality of different colors of light, at least one light exit surface coupled to the first chamber and configured to further mix light emitted from the light sources, and a second chamber containing the light sources and having at least one wall and an opening in communication with the first chamber. The wall is configured to prevent the light emitted from the light sources from directly impinging upon the light exit surface. The opening is configured to permit the light emitted from the light sources to travel through the opening from the second chamber to the first chamber. The first chamber and the light exit surface are configured together to mix the light emitted from the light sources such that all light exiting the at least one light exit surface is substantially uniform in brightness and color.

In some embodiments, the light exit surface includes at least one directly viewable surface. In at least one embodiment, the light exit surface includes at least one transmissive diffusive surface.

In some embodiments, the first chamber includes at least one light reflecting surface. In at least one embodiment, the light reflecting surface is configured to diffusively reflect at least a portion of the light emitted from the light sources toward the at least one light exit surface. In at least one embodiment, the first chamber is configured to mix light such that several different colors of light overlap before reaching the light exit surface.

In some embodiments, the luminaire includes a lens, a prism, a specular reflector and/or a light diffuser disposed in the opening. In at least one embodiment, the luminaire includes a transmissive light diffuser disposed within the first chamber between the opening and the light exit surface.

In another aspect, a method of producing illumination using a luminaire having a first chamber and a second chamber coupled to the first chamber and containing a plurality of light sources includes generating a plurality of different colors of light within the second chamber, configuring an opening between the first and second chambers such that light emitted from the light sources is permitted to travel through the opening from the second chamber into the first chamber, blocking the light emitted from the light sources from directly impinging upon the light exit surface using at least one wall, and mixing the plurality of different colors of light using the first chamber and the exit surface in combination such that all light exiting the light exit surface is substantially uniform in brightness and color. In at least one embodiment, the light exit surface is directly viewable.

In some embodiments, mixing the plurality of different colors of light includes diffusing the light emitted from the light sources before the light impinges upon the at least one light exit surface. In at least one embodiment, the method further includes mixing at least a portion of the light emitted from the light sources using the second chamber.

In yet another aspect, a luminaire includes a plurality of light sources configured to, in combination, generate a plurality of different colors of light, a first chamber, at least one direct-view light exit surface coupled to the first chamber, a second chamber containing the light sources and having an opening in communication with the first chamber configured to permit light emitted from the light sources to travel through the opening from the second chamber to the first chamber, and means for mixing the light emitted from the light sources such that all light exiting the at least one light exit surface is substantially uniform in brightness and color.

In some embodiments, the means for mixing the light includes at least one reflective diffuser and at least one transmissive diffuser.

As used herein for purposes of the present disclosure, the term "LED" should be understood to include any electroluminescent diode or other type of carrier injection/junction-based system that is capable of generating radiation in response to an electric signal. Thus, the term LED includes, but is not limited to, various semiconductor-based structures that emit light in response to current, light emitting polymers, organic light emitting diodes (OLEDs), electroluminescent strips, and the like. In particular, the term LED refers to light emitting diodes of all types (including semi-conductor and organic light emitting diodes) that may be configured to generate radiation in one or more of the infrared spectrum, ultraviolet spectrum, and various portions of the visible spectrum (generally including radiation wavelengths from approximately 400 nanometers to approximately 700 nanometers). Some examples of LEDs include, but are not limited to, various types of infrared LEDs, ultraviolet LEDs, red LEDs, blue LEDs, green LEDs, yellow LEDs, amber LEDs, orange LEDs, and white LEDs (discussed further below). It also should be appreciated that LEDs may be configured and/or controlled to generate radiation having various bandwidths (e.g., full widths at half maximum, or FWHM) for a given spectrum (e.g., narrow bandwidth, broad bandwidth), and a variety of dominant wavelengths within a given general color categorization.

For example, one implementation of an LED configured to generate essentially white light (e.g., a white LED) may include a number of dies which respectively emit different spectra of electroluminescence that, in combination, mix to form essentially white light. In another implementation, a white light LED may be associated with a phosphor material that converts electroluminescence having a first spectrum to a different second spectrum. In one example of this implementation, electroluminescence having a relatively short wavelength and narrow bandwidth spectrum "pumps" the phosphor material, which in turn radiates longer wavelength radiation having a somewhat broader spectrum.

It should also be understood that the term LED does not limit the physical and/or electrical package type of an LED. For example, as discussed above, an LED may refer to a single light emitting device having multiple dies that are configured to respectively emit different spectra of radiation (e.g., that may or may not be individually controllable). Also, an LED may be associated with a phosphor that is considered as an integral part of the LED (e.g., some types of white LEDs). In general, the term LED may refer to packaged LEDs, non-packaged LEDs, surface mount LEDs, chip-on-board LEDs, T-package mount LEDs, radial package LEDs, power package LEDs, LEDs including some type of encasement and/or optical element (e.g., a diffusing lens), etc.

The term "light source" should be understood to refer to any one or more of a variety of radiation sources, including, but not limited to, LED-based sources (including one or more LEDs as defined above), incandescent sources (e.g., filament lamps, halogen lamps), fluorescent sources, phosphorescent sources, high-intensity discharge sources (e.g., sodium vapor, mercury vapor, and metal halide lamps), lasers, other types of electroluminescent sources, pyroluminescent sources (e.g., flames), candle-luminescent sources (e.g., gas mantles, carbon arc radiation sources), photo-luminescent sources (e.g., gaseous discharge sources), cathode luminescent sources using electronic satiation, galvano-luminescent sources, crystallo-luminescent sources, kine-luminescent sources, thermo-luminescent sources, triboluminescent sources, sonoluminescent sources, radioluminescent sources, and luminescent polymers.

A given light source may be configured to generate electromagnetic radiation within the visible spectrum, outside the visible spectrum, or a combination of both. Hence, the terms "light" and "radiation" are used interchangeably herein. Additionally, a light source may include as an integral component one or more filters (e.g., color filters), lenses, or other optical components. Also, it should be understood that light sources may be configured for a variety of applications, including, but not limited to, indication, display, and/or illumination. An "illumination source" is a light source that is particularly configured to generate radiation of sufficient flux to effectively illuminate an interior or exterior space. In this context, "sufficient flux" refers to sufficient luminoua power in the visible spectrum generated in the space or environment (the unit "lumens" often is employed to represent the total light output from a light source in all directions, in terms of radiant power or "luminous flux") to provide ambient illumination (i.e., light that may be perceived indirectly and that may be, for example, reflected off of one or more of a variety of intervening surfaces before being perceived in whole or in part).

The term "spectrum" should be understood to refer to any one or more frequencies (or wavelengths) of radiation produced by one or more light sources. Accordingly, the term "spectrum" refers to frequencies (or wavelengths) not only in the visible range, but also frequencies (or wavelengths) in the infrared, ultraviolet, and other areas of the overall electromagnetic spectrum. Also, a given spectrum may have a relatively narrow bandwidth (e.g., a FWHM having essentially few frequency or wavelength components) or a relatively wide bandwidth (several frequency or wavelength components having various relative strengths). It should also be appreciated that a given spectrum may be the result of a mixing of two or more other spectra (e.g., mixing radiation respectively emitted from multiple light sources).

For purposes of this disclosure, the term "color" is used interchangeably with the term "spectrum." However, the term "color" generally is used to refer primarily to a property of radiation that is perceivable by an observer (although this usage is not intended to limit the scope of this term). Accordingly, the terms "different colors" implicitly refer to multiple spectra having different wavelength components and/or bandwidths. It also should be appreciated that the term "color" may be used in connection with both white and non-white light.

The term "color temperature" generally is used herein in connection with white light, although this usage is not intended to limit the scope of this term. Color temperature essentially refers to a particular color content or shade (e.g., reddish, bluish) of white light. The color temperature of a given radiation sample conventionally is characterized according to the temperature in Kelvin (K) of a black body radiator that radiates essentially the same spectrum as the radiation sample in question. Black body radiator color temperatures generally fall within a range of from approximately 700K (typically considered the first visible to the human eye) to over 10,000 K; white light generally is perceived at color temperatures above 1500-2000K.

The terms "lighting fixture" or "luminaire" are used herein interchangeably to refer to an implementation or arrangement of one or more lighting units or a plurality of light sources in a particular form factor, assembly, or package. The term "lighting unit" is used herein to refer to an apparatus including one or more light sources of same or different types. A given lighting unit may have any one of a variety of mounting arrangements for the light source(s), enclosure/housing arrangements and shapes, and/or electrical and mechanical connection configurations. Additionally, a given lighting unit optionally may be associated with (e.g., include, be coupled to and/or packaged together with) various other components (e.g., control circuitry) relating to the operation of the light source(s). An "LED-based lighting unit" refers to a lighting unit that includes one or more LED-based light sources as discussed above, alone or in combination with other non LED-based light sources. A "multi-channel" lighting unit refers to an LED-based or non LED-based lighting unit that includes at least two light sources configured to respectively generate different spectrums of radiation, wherein each different source spectrum may be referred to as a "channel" of the multi-channel lighting unit.

The term "direct-view luminaire" is used herein generally to describe various lighting fixtures in which the light emitted from the lighting fixture exits the fixture at a location directly viewable by an observer. A direct-view luminaire can include one or more light-emitting surfaces located such that at least a portion of the light emitting surface is directly viewable by the observer. It should be appreciated that light sources included in a direct-view luminaire may be blocked from direct view.

The term "controller" is used herein generally to describe various apparatus relating to the operation of one or more light sources. A controller can be implemented in numerous ways (e.g., such as with dedicated hardware) to perform various functions discussed herein. A "processor" is one example of a controller which employs one or more microprocessors that may be programmed using software (e.g., microcode) to perform various functions discussed herein. A controller may be implemented with or without employing a processor, and also may be implemented as a combination of dedicated hardware to perform some functions and a processor (e.g., one or more programmed microprocessors and associated circuitry) to perform other functions. Examples of controller components that may be employed in various embodiments of the present disclosure include, but are not limited to, conventional microprocessors, application specific integrated circuits (ASICs), and field-programmable gate arrays (FPGAs).

In various implementations, a processor or controller may be associated with one or more storage media (generically referred to herein as "memory," e.g., volatile and non-volatile computer memory such as RAM, PROM, EPROM, and EEPROM, floppy disks, compact disks, optical disks, magnetic tape, etc.). In some implementations, the storage media may be encoded with one or more programs that, when executed on one or more processors and/or controllers, perform at least some of the functions discussed herein. Various storage media may be fixed within a processor or controller or may be transportable, such that the one or more programs stored thereon can be loaded into a processor or controller so as to implement various aspects of the present invention discussed herein. The terms "program" or "computer program" are used herein in a generic sense to refer to any type of computer code (e.g., software or microcode) that can be employed to program one or more processors or controllers.

In one network implementation, one or more devices coupled to a network may serve as a controller for one or more other devices coupled to the network (e.g., in a master/slave relationship). In another implementation, a networked environment may include one or more dedicated controllers that are configured to control one or more of the devices coupled to the network. Generally, multiple devices coupled to the network each may have access to data that is present on the communications medium or media; however, a given device may be "addressable" in that it is configured to selectively exchange data with (i.e., receive data from and/or transmit data to) the network, based, for example, on one or more particular identifiers (e.g., "addresses") assigned to it.

The term "network" as used herein refers to any interconnection of two or more devices (including controllers or processors) that facilitates the transport of information (e.g. for device control, data storage, data exchange, etc.) between any two or more devices and/or among multiple devices coupled to the network. As should be readily appreciated, various implementations of networks suitable for interconnecting multiple devices may include any of a variety of network topologies and employ any of a variety of communication protocols. Additionally, in various networks according to the present disclosure, any one connection between two devices may represent a dedicated connection between the two systems, or alternatively a non-dedicated connection. In addition to carrying information intended for the two devices, such a non-dedicated connection may carry information not necessarily intended for either of the two devices (e.g., an open network connection). Furthermore, it should be readily appreciated that various networks of devices as discussed herein may employ one or more wireless, wire/cable, and/or fiber optic links to facilitate information transport throughout the network.

It should be appreciated that all combinations of the foregoing concepts and additional concepts discussed in greater detail below (provided such concepts are not mutually inconsistent) are contemplated as being part of the inventive subject matter disclosed herein. In particular, all combinations of claimed subject matter appearing at the end of this disclosure are contemplated as being part of the inventive subject matter disclosed herein. It should also be appreciated that terminology explicitly employed herein that also may appear in any disclosure incorporated by reference should be accorded a meaning most consistent with the particular concepts disclosed herein.

BRIEF DESCRIPTION OF THE DRAWINGS

In the drawings, like reference characters generally refer to the same parts throughout the different views. Also, the drawings are not necessarily to scale, emphasis instead generally being placed upon illustrating the principles of the invention.

DETAILED DESCRIPTION

As discussed above, one important characteristic of a direct-view luminaire is the uniform appearance of the surface that emits light such that individual light sources or different colors are not visually discernable. Known solutions for achieving uniform appearance in direct-view applications are often complex and inefficient. Applicants have recognized and appreciated that the uniformity of the light-emitting surface of a direct-view luminaire can be improved by employing a combination of mixing chambers. The mixing chambers provide light mixing and prevent light emitted from light sources included therein from directly impinging on the light-emitting surface. In view of the foregoing, various embodiments and implementations of the present invention are directed to apparatus and methods for mixing light using a combination of a first light mixing chamber and at least one second light mixing chamber.

Figure 1A:
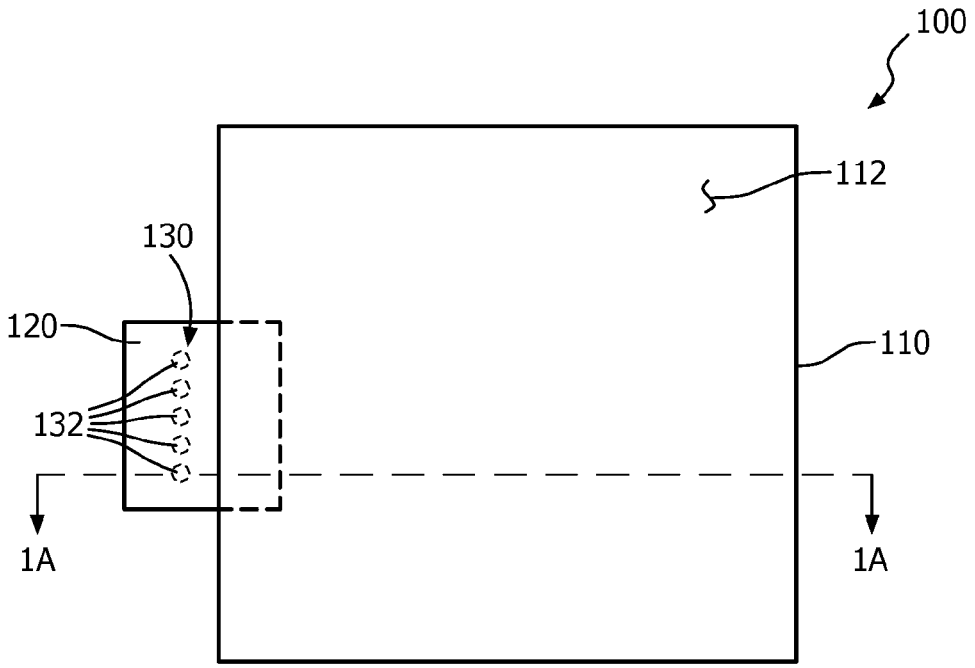
FIG. 1A illustrates a top view of a luminaire in accordance with an embodiment.

FIG. 1A is a top view of one embodiment of a luminaire 100. As shown in FIG. 1A, the luminaire 100 includes a first light mixing chamber 110 and a second light mixing chamber 120 coupled to the first chamber 110. The second chamber 120 includes a plurality of light sources 130. The light sources 130 can be configured to, in combination, generate several different colors of light, for example, with one or more LEDs 132 arranged in groups of similar or dissimilar colors. As will be described below, light emitted by the light sources 130 travels from the second chamber 120 into the first chamber 110, where at least a portion of the light is mixed. A light exit surface 112 is coupled to the first chamber 110 and configured to permit at least some of the light within the first chamber 110 to travel through the light exit surface 112 such that the light exiting the surface 112 is directly viewable by an observer.

It should be appreciated that in some embodiments the light sources 130 can include non-LED light sources, such as traditional fluorescent, high-intensity discharge (HID), and incandescent lamps. Further, any of the preceding may be employed alone or in combination with one another and/or LEDs in luminaires in accordance with various embodiments of the invention. In some embodiments, the light sources 130 can be included in a lighting unit or a plurality of lighting units. In further embodiments, the light sources can be included in a multi-channel lighting unit or a plurality of multi-channel lighting units.

Figure 1B:
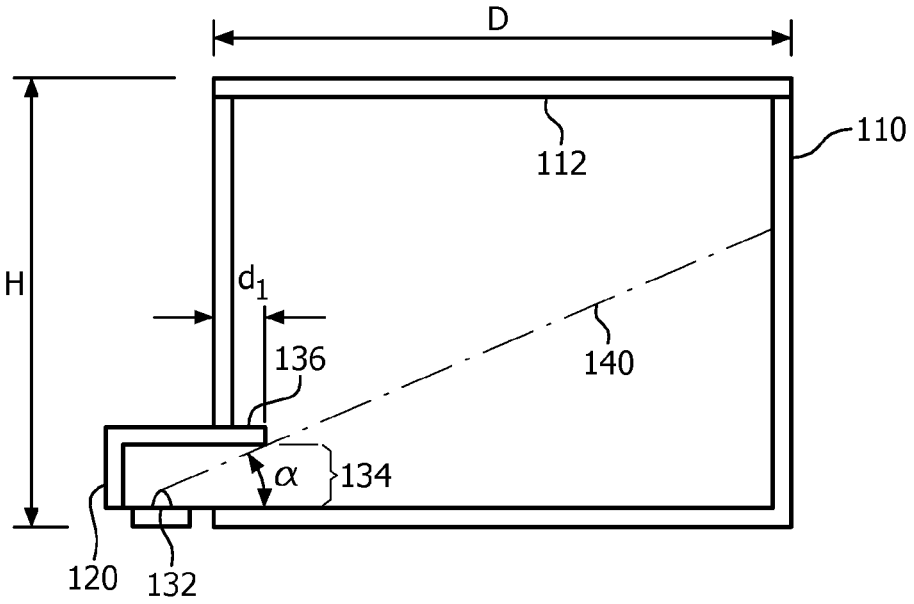
FIG. 1B illustrates a cross-sectional side view of a luminaire of FIG. 1A along a cut line 1A-1A.

FIG. 1B is a side cross-section view of the luminaire 100 of FIG. 1A along a cut line 1A-1A. The first chamber 110 generally has dimensions of D depth and H height. The height H, in some embodiments, is approximately 6 centimeters (cm) or less, allowing the luminaire 100 to have a low profile, although it should be appreciated that heights greater than 6 cm can be used. The second chamber 120 includes an opening 134 in communication with the first chamber 110, and at least one wall 136. In some embodiments, the wall 136 protrudes into the first chamber 110 by a dimension $d_1$. The wall 136 is configured to prevent light emitted by the light sources 130, a portion of which is shown by dashed line 140, from directly impinging upon the light exit surface 112. For example, while light emitted from LED 132 may travel away from the LED in several directions, only light traveling away from the LED within an angular range of a degrees (as shown in FIG. 1B) will directly travel through the opening 134 from the second chamber 120 into the first chamber 110, such as the portion of light indicated at 140. In this configuration, no light emitted from the LED 132 can directly impinge upon the light exit surface 112 because there is no line-of-sight between the LED 132 and the light exit surface 112. This forces the light to interact with at least the first chamber 110, where it is mixed, before it reaches the light exit surface 112. Additionally, some of the light emitted by the light sources 130 may optionally be mixed in the second chamber 120 before entering the first chamber 110.

Because the second chamber 120 protrudes into the first chamber 110, the area above the wall 136 within the first chamber 110 is darker than other areas of the first chamber 110 when the light sources 130 is producing light. Further, the area near the opening 134 appears brighter than other areas of the first chamber 110. Thus, variations in the brightness of the light in different areas of the first chamber 110 may exist. In one embodiment, the light exit surface 112 includes a light transmissive diffuser. In some embodiments, the diffusive property of the light exit surface 112 compensates for the variations in brightness of the light in the first chamber 110 by uniformly mixing the light such that all light exiting the surface 112 (e.g., light directly viewable from the luminaire 100) is substantially uniform in brightness and color. Consequently, individual light sources (e.g., LED 132) and individual colors emitted by the light sources 130 are not discernable by an observer directly viewing the light exit surface 112.

As discussed above, the geometry of the luminaire 100 provides for light mixing within at least the first chamber 110 and prevents light from the light sources 130 from directly impinging upon the light exit surface 112. In some embodiments, the first chamber 110 is larger than the second chamber 120. The first chamber 110, the second chamber 120, the wall 136 and the light sources 130 in combination enable the luminaire 100 to have a low profile of approximately 6 cm or less at least because the wall 136 prevents light from directly impinging upon the light exit surface 112 regardless of the height H of the first chamber 110. Furthermore, the light is forced to mix in the first chamber 110 before traveling through the light exit surface 112, which aids in producing uniformly colored and bright light. In some embodiments, the depth $d_1$ at which the wall 136 protrudes into the first chamber 110 can be varied according to the location of the light sources 130 (e.g., LED 132) in the second chamber 120. For example, the depth $d_1$ and/or the location of the light sources 130 may be varied such that the light emitted by the light sources 130 does not directly impinge upon the light exit surface 112.

Figure 2:
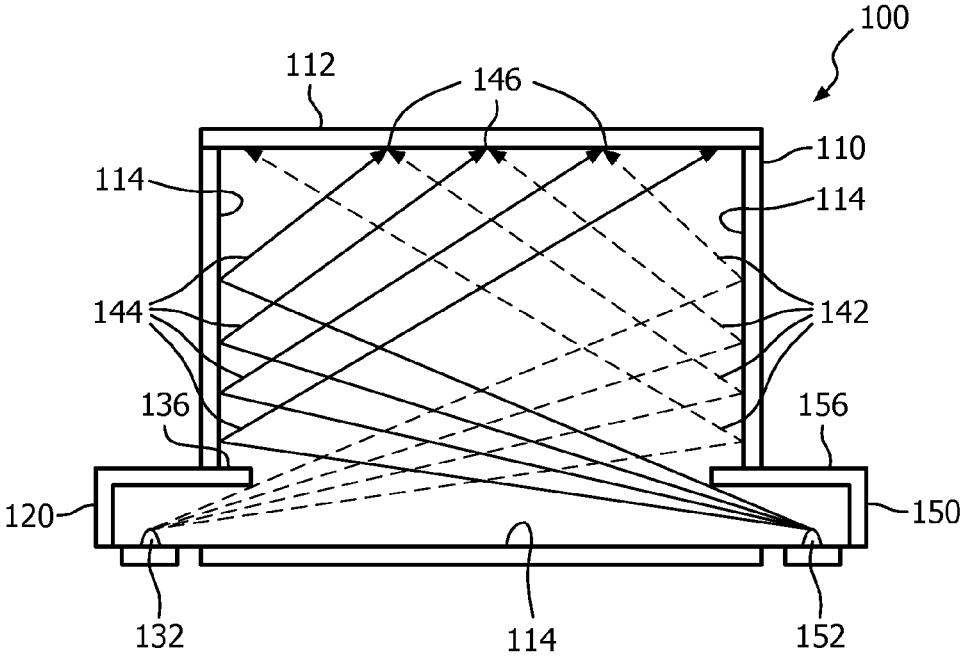
FIG. 2 illustrates a cross-sectional side view of a luminaire showing patterns of light travel in accordance with an embodiment.

Referring to FIG. 2, in one embodiment, the luminaire 100 includes a third light mixing chamber 150 coupled to the first chamber 110 in a manner similar to the second chamber 120, but at a different location on the first chamber 110. The third chamber 150 includes at least one wall 156, which protrudes into the first chamber 110. The second chamber 120 contains a first portion of the light sources 130, for example, LED (or LEDs) 132, and the third chamber 150 contains a second portion of the light sources 130, for example, LED (or LEDs) 152. The first portion of the light sources 130 may all be configured to emit a single color of light or several different colors of light. Similarly, the second portion of the light sources 130 may be configured to emit a single color of light, for example, a color the same as or different than the first portion, or several different colors of light. It should be appreciated that any number of light mixing chambers can be coupled to the first chamber 110 in a manner similar to the second chamber 120 and/or the third chamber 150. Further, in some embodiments, each light mixing chamber can include one or more lighting units and/or multi-channel lighting units. In some embodiments, one or more of the light sources 130 (e.g., individual LEDs) may be integrated into an assembly forming the lighting unit and/or multi-channel lighting unit.

In one embodiment, the first chamber 110 of the luminaire 100 includes at least one light reflecting surface 114. The light reflecting surface(s) 114 may, for example, be located on or near the sidewalls or bottom wall of the first chamber 110, and may face generally toward an interior portion of the first chamber 110 such that light within the first chamber 110 reflects off of the surface(s) 114. In one example, LED 132 emits light indicated by the dashed lines 142 and LED 152 emits light indicated by the solid lines 144. The light 142 enters the first chamber 110 from the second chamber 120, and the light 144 enters the first chamber 110 from the third chamber 150. The light 142 and the light 152 is mixed in the first chamber 110 at least in part by reflecting off of the light reflecting surface(s) 114 one or more times before reaching the light exit surface 112. The light reflecting surface 114 can, in some embodiments, include a light diffusive reflecting surface, which further aids in the mixing of the light by scattering light reflected off of the surface 114 in several different directions.

In another embodiment, the second chamber 120 and/or the third chamber 150 include one or more light reflecting surfaces (not shown). Some of the light 142 is mixed within the second chamber 120 and some of the light 144 is mixed within the third chamber 150 by reflecting off of the light reflecting surfaces therein.

In one embodiment, the light 142 is a first color of light, and the light 144 is a second color of light different from the first color. At least some of the light 142, 144 is reflected by the reflecting surfaces 114 in the first chamber 110 such that the light 142, 144 arrives at common points 146 of the light exit surface 112, causing the light 142, 144, and therefore the different colors, to mix at the common points 146. Other portions (not shown) of the light 142, 144 arrive at different points on the light exit surface 112.

Figure 3:
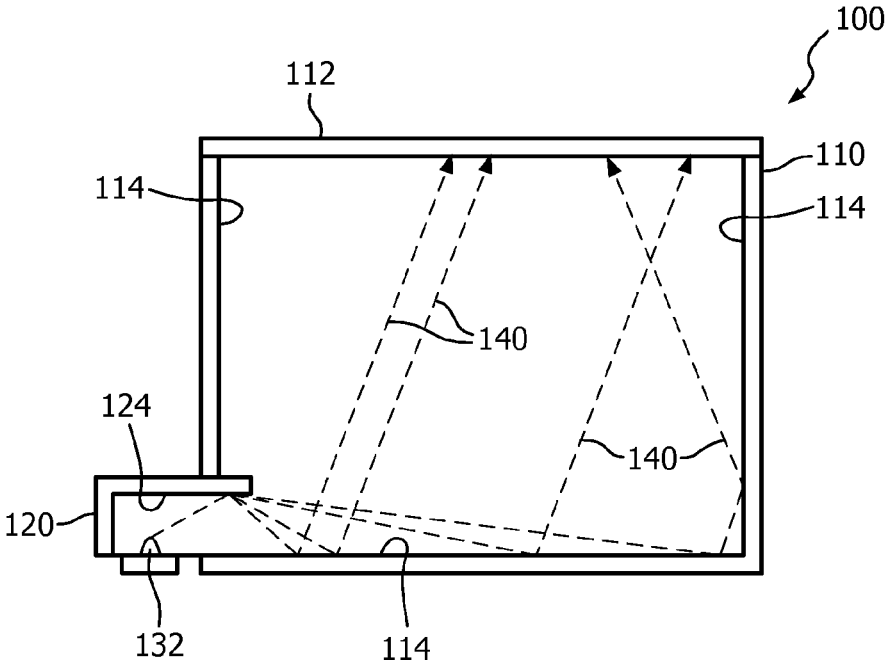
FIG. 3 illustrates a cross-sectional side view of the luminaire of FIG. 1A showing another pattern of light travel in accordance with an embodiment.

As discussed above, in particular with reference to FIG. 2, the luminaire 100 can include any number of light mixing chambers, according to some embodiments. Referring to FIG. 3, in one embodiment, the luminaire 100 includes the first chamber 110 and the second chamber 120. The first chamber 110 of the luminaire 100 includes at least one light reflecting surface 114. The light reflecting surface(s) 114 may, for example, be located on or near the sidewalls or bottom wall of the first chamber 110, and may face generally toward an interior portion of the first chamber 110 such that light within the first chamber 110 reflects off of the surface(s) 114. In one example, LED 132 emits light indicated by the dashed lines 140. The light 140 enters the first chamber 110 from the second chamber 120, and is mixed in the first chamber 110 by reflecting off of the light reflecting surface(s) 114 one or more times before impinging upon the light exit surface 112. The light reflecting surface 114 can, in some embodiments, include a light diffusive reflecting surface, which further aids in the mixing of the light by scattering light reflected off of the surface 114 in several different directions. In another embodiment, the second chamber 120 includes at least one light reflecting surface 124. Some of the light 140 emitted by the LED 132 can be mixed in the second chamber 120 by reflecting off of the light reflecting surface(s) 124 of the second chamber before entering the first chamber 110.

Figure 4:
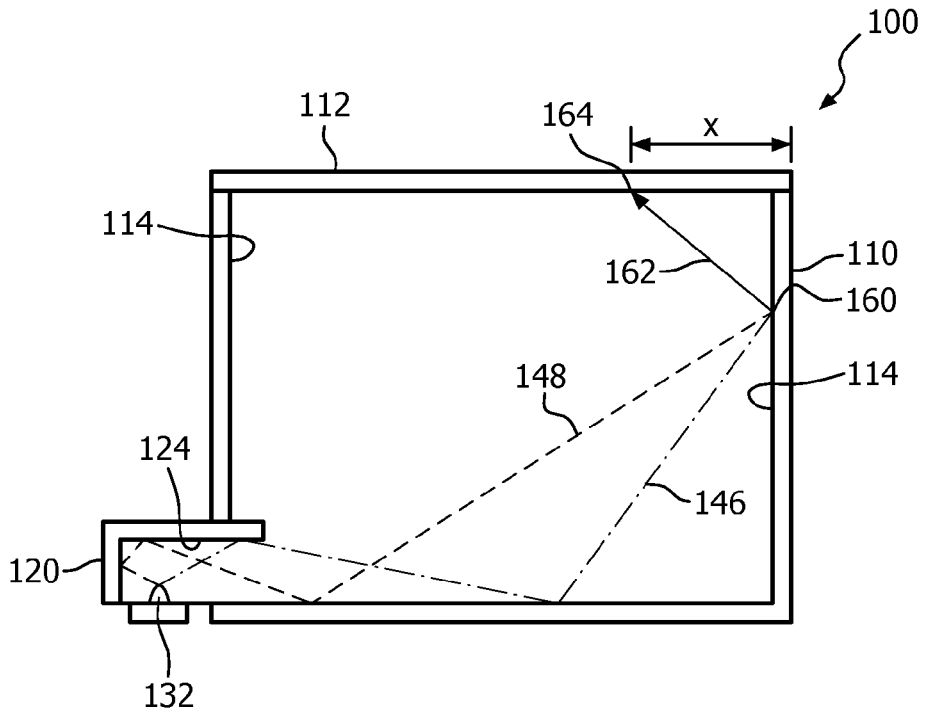
FIG. 4 illustrates a cross-sectional side view of the luminaire of FIG. 1A showing yet another pattern of light travel in accordance with an embodiment.

As discussed above, the second chamber 120 may include at least one light reflecting surface therein. Referring to FIG. 4, in one embodiment, light from LED 132, shown by dashed lines 146 and 148, travels away from the LED 132 in different directions and reflects off of the light reflecting surfaces 114 and 124, mixing within the first chamber 110 and/or second chamber 120. Some of the light 146, 148 reflects off of the light reflecting surface 114 at a common point of incidence 160 in the same direction (i.e., the light 146 and 148 overlaps after reflecting off of the point 160), shown by line 162, and arrives at a point 164 on the light exit surface 112. The light 162 therefore includes a combination of the light 146 and 148. For example, if the light 146 and 148 are different colors, the light 162 includes a mixture of the different colors. This is possible because the reflections off of the light reflecting surfaces 114 (and, optionally, light reflecting surfaces 124) are diffuse. When other light (not shown) arrives at other points of the light exit surface 112 in a similar manner to the light 162, the result is that all or nearly all light reaching the light exit surface 112 is substantially uniform in color. The light exit surface 112, in some embodiments, may be configured to further mix the light to provide additional improvements in uniformity of color and brightness.

Figure 5:
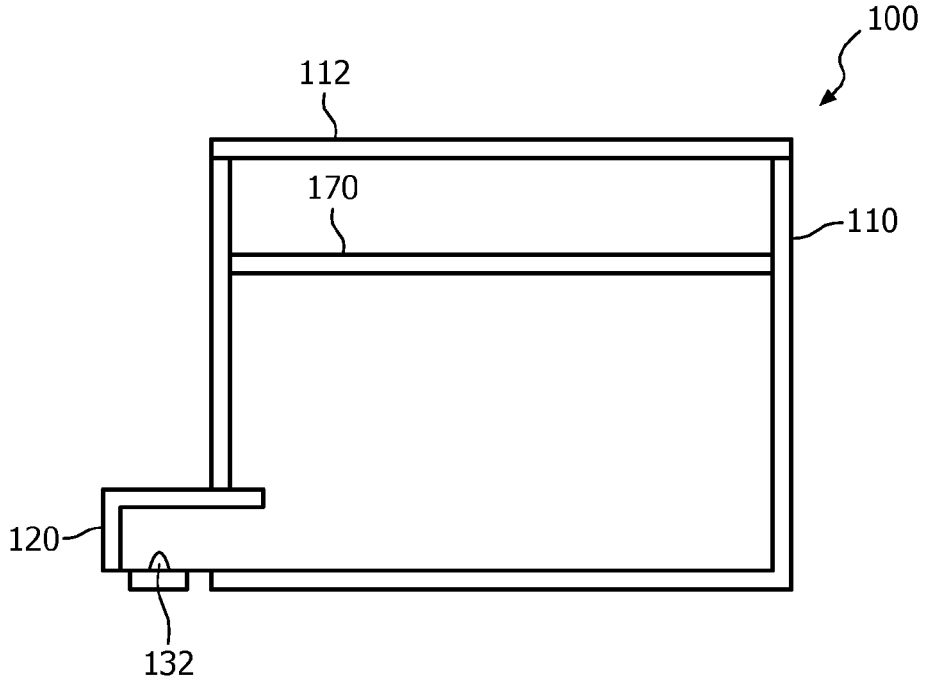
FIG. 5 illustrates a cross-sectional side view of another embodiment of a luminaire.

As discussed above, the light mixing chambers (e.g., the first light mixing chamber 110 and the second light mixing chamber 120 of FIGS. 1A and 1B) may be used to mix light, in particular, different colors of light. Referring to FIG. 5, in one embodiment, a transmissive diffuser 170 is disposed within the first chamber 110 between the light exit surface 112 and the second chamber 120. The transmissive diffuser 170 is configured to further mix the light within the first chamber 110 by diffusing light traveling within the first chamber 110 before the light reaches the light exit surface 112. In another embodiment (not shown), the luminaire 100 may optionally include multiple transmissive diffusers disposed within the first chamber 110 between the light exit surface 112 and the second chamber 120. In some embodiments, the transmissive diffuser 170 may be oriented horizontally across the interior of the first chamber 110 or at another angle to mix light in one of a number of different ways. In another embodiment, the transmissive diffuser 170 may extend across a portion of the interior of the first chamber 110. In various embodiments, the use of multiple transmissive diffusers can act to more completely mix the light observed at the light exit surface 112.

Figure 6:
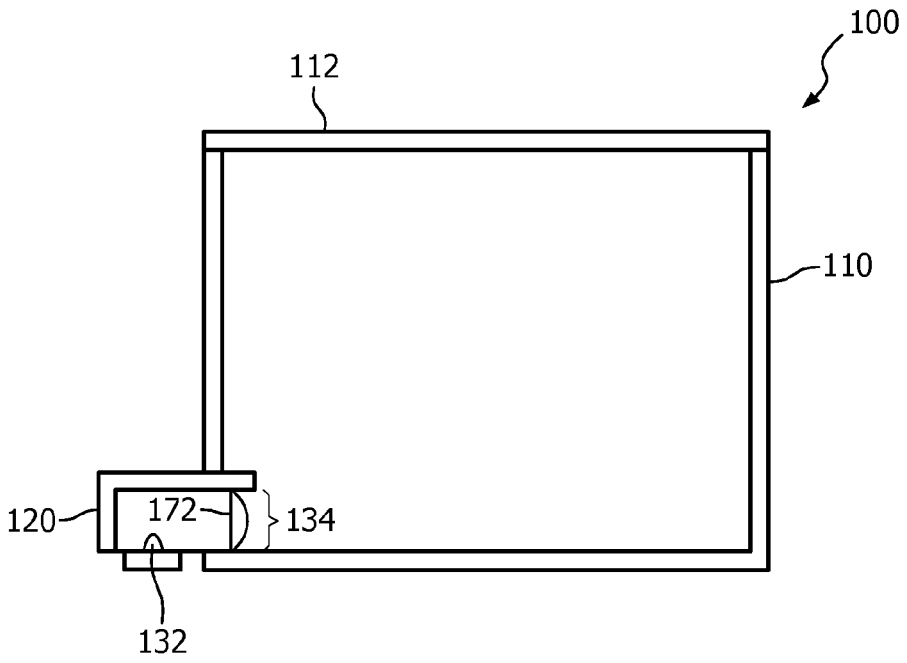
FIG. 6 illustrates a cross-sectional side view of yet another embodiment of a luminaire.

As discussed above with respect to FIG. 5, other optical elements, such as the transmissive diffuser 170, may optionally be included in the luminaire 100 to improve the light mixing characteristics of the luminaire 100. In some embodiments, other types of optical elements and arrangements thereof can be used. Referring to FIG. 6, in one embodiment, a lens, prism, specular reflector, or diffuser 172 is disposed within the opening 134 of the second chamber 120. The lens, prism, specular reflector, or diffuser 172 is configured to mix the light traveling from the second chamber 120 to the first chamber 110 before it reaches the first chamber 110. In another embodiment (not shown), the lens, prism, or specular reflector 172 may be disposed upon one or more of the LEDs 132 to mix or redirect the light as it is emitted, for example to direct the light toward a particular location or locations in the first mixing chamber in order to improve color mixing or uniformity. In some embodiments, the transmissive diffuser 170 (or multiple transmissive diffusers) in the first chamber 110 can be employed in combination with the element 172 included in the opening 134.

Figure 7:
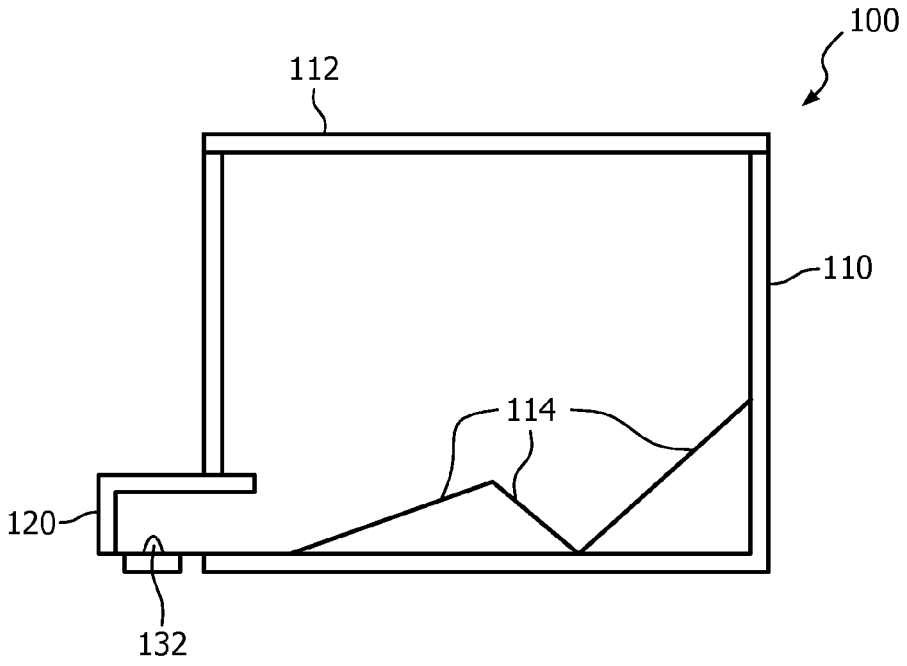
FIG. 7 illustrates a cross-sectional side view of still another embodiment of a luminaire.

As shown in, and described with respect to, for example, FIG. 2, the luminaire 100 may include one or more light reflecting surfaces 114. In some embodiments, the light reflecting surface(s) 114 are substantially parallel to the interior side, top or bottom walls of the first chamber 110 and/or other chambers (e.g., the second chamber 120 and the third chamber 150), such as shown in FIG. 2. Referring to FIG. 7, in one embodiment, at least some of the light reflecting surfaces 114 of the first chamber 110 are tilted. In another embodiment (not shown), at least some of the light reflecting surfaces of the second chamber 120 are tilted. By tilting various light reflecting surfaces, the light in the corresponding chamber(s) can be adjusted to reflect within the respective light mixing chambers several times and/or in a variety of different directions to aid in mixing and providing light that is uniform in color and brightness.

Figure 8:
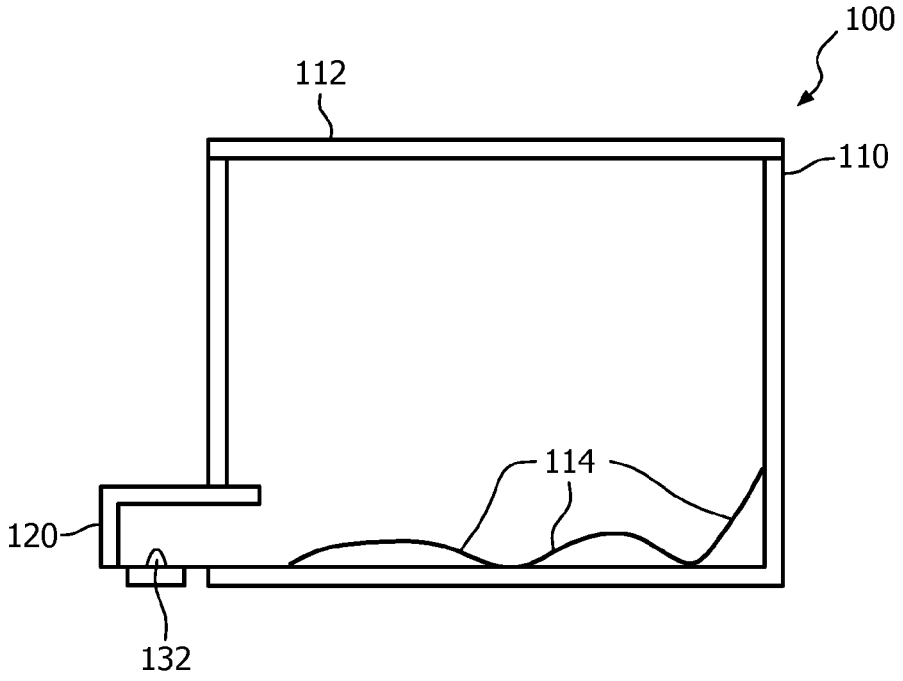
FIG. 8 illustrates a cross-sectional side view of another embodiment of a luminaire.

Referring to FIG. 8, in another embodiment, at least some of the light reflecting surfaces 114 of the first chamber 110 are curved in one or more dimensions. As with the titled reflecting surfaces described above, adjusting the curves of the reflecting surface(s) 114 aids in mixing by varying the number of reflections and/or directions of light reflected therefrom. In some embodiments, the light reflecting surface(s) 114 may include bumps and/or other textures (not shown), which may be distributed evenly or unevenly within the first chamber 110 and/or second chamber 120. Such bumps or textures can be used to further improve the mixing of light using the diverse reflective characteristics of the surface(s) 114.

Figure 9:
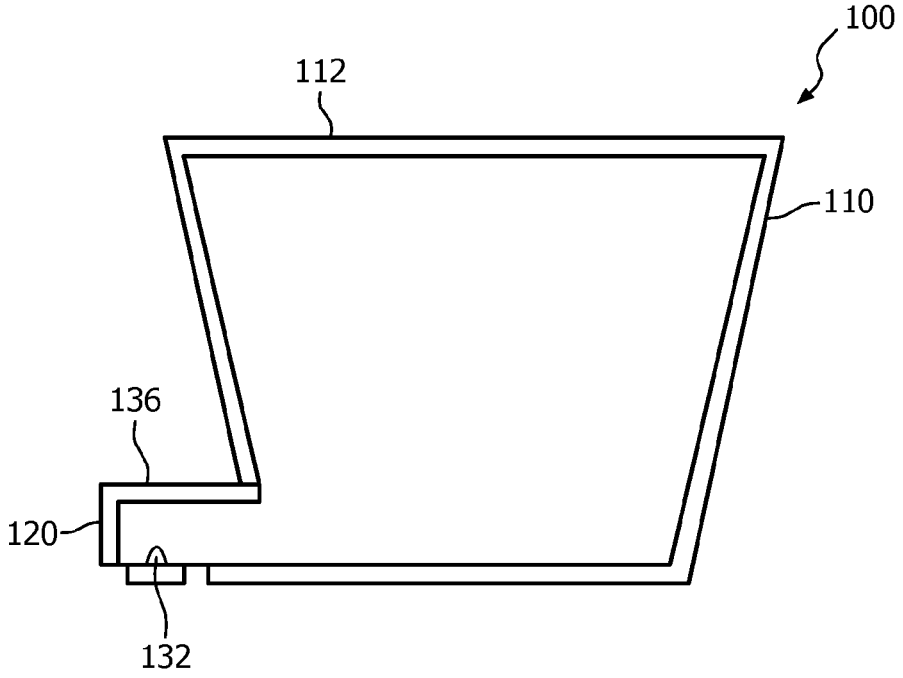
FIG. 9 illustrates a cross-sectional side view of yet another embodiment of a luminaire.

Referring to FIG. 9, in one embodiment, one or more sidewalls of the first chamber 110 of the luminaire 100 are flared inward or outward. The sidewalls may be straight or curved. In some embodiments, flared sidewalls provide similar light mixing benefits to those described above with reference to the tilted or curved light reflecting surfaces in FIGS. 7 and 8, as will be appreciated by one of skill in the art.

Figure 10:
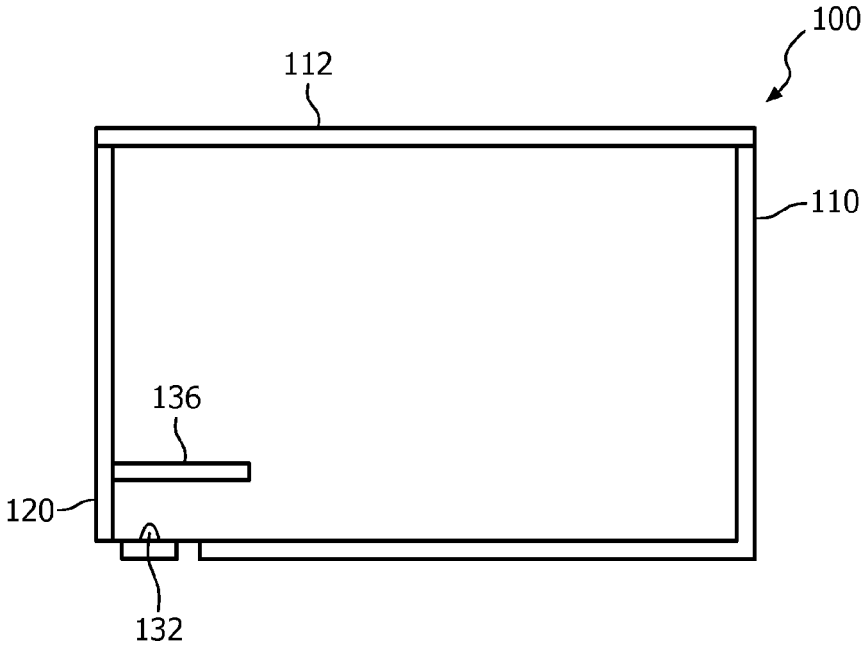
FIG. 10 illustrates a cross-sectional side view of still another embodiment of a luminaire.

As discussed above, in some embodiments the second chamber 120 (and other chambers, such as the third chamber 150 shown in FIG. 2) may protrude into the first chamber 110 by some distance $d_1$, for example, as shown in the embodiment of FIG. 1B. Other geometric configurations of the various light mixing chambers are possible. Referring to FIG. 10, in one embodiment, the second chamber 120 is contained entirely within the first chamber 110 of the luminaire 100. In this embodiment, one end of the second chamber 120 is flush with a sidewall of the first chamber 110, allowing the luminaire 100 to be relatively compact in size. According to the illustrated embodiment, the wall 136 is configured to prevent light emitted from the light sources (e.g., LED 132) from directly impinging upon the light exit surface 112.

Figure 11:
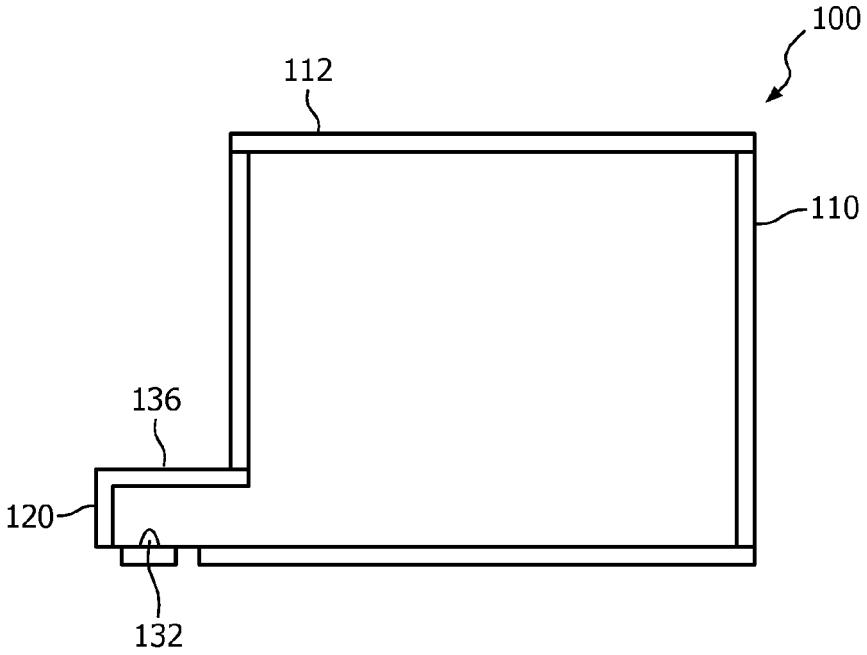
FIG. 11 illustrates a cross-sectional side view of another embodiment of a luminaire.
Figure 12:
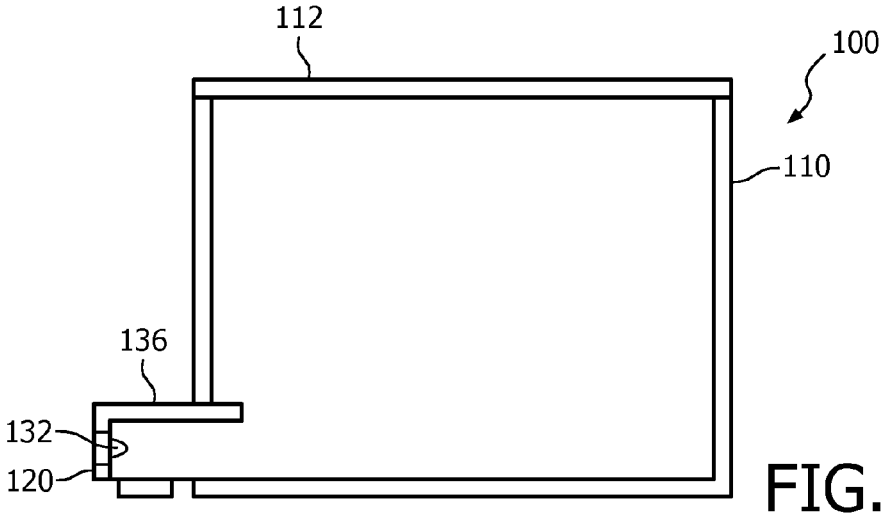
FIG. 12 illustrates a cross-sectional side view of yet another embodiment of a luminaire.

Another geometric configuration is shown in FIG. 11 where the second chamber 120 is external to the first chamber 110 of the luminaire 100, according to one embodiment. In this configuration, the wall 136 does not protrude into the first chamber 110. Referring to FIG. 12, in yet another embodiment, the LEDs 132 are oriented to face toward the center of the first chamber 110 instead of upward (such as shown in the luminaire 100 of FIG. 1B). Thus, according to some embodiments, the location and/or orientation of the second chamber 120 and/or the light sources (e.g., including LED 132) may vary, providing flexibility in the design, construction and performance of the luminaire 100. For example, by orienting the LED 132 towards the first chamber 110, more light can directly enter the first chamber 110 (depending on the emission characteristics of the LED 132), which can provide a more efficient use of the light.

Figure 13:
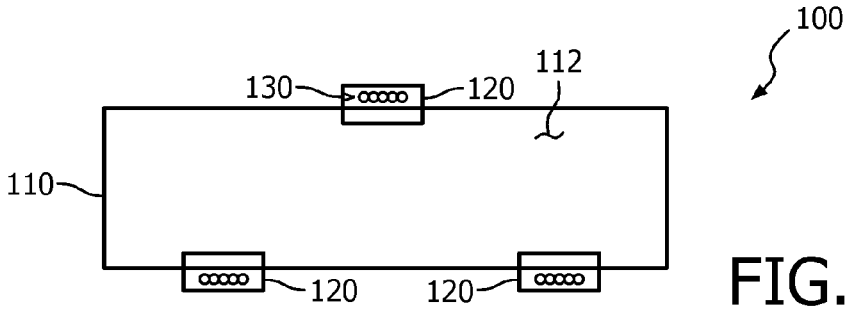
FIG. 13 is a top view of another embodiment of a luminaire.
Figure 14:
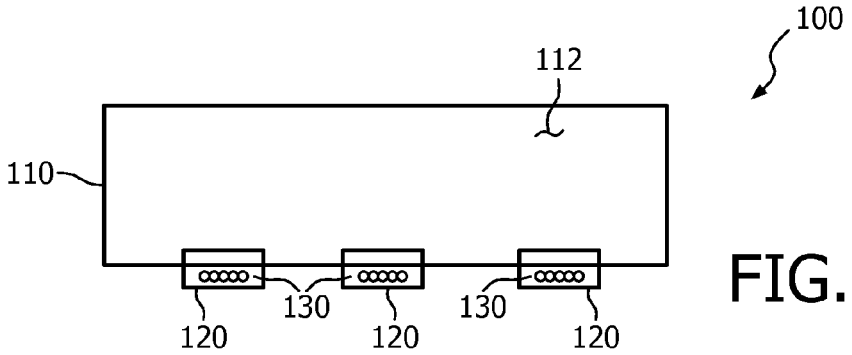
FIG. 14 is a top view of yet another embodiment of a luminaire.
Figure 15:
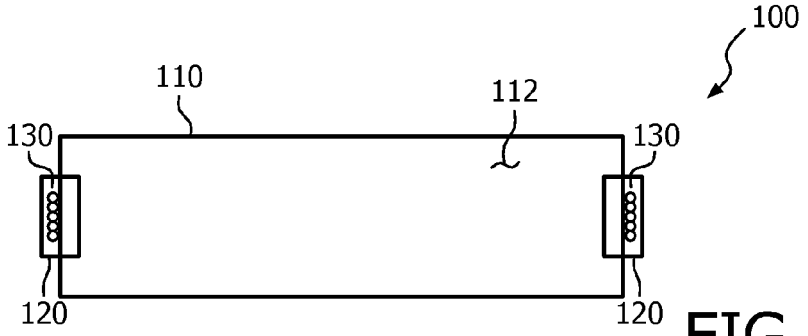
FIG. 15 is a top view of still another embodiment of a luminaire.

FIGS. 13, 14 and 15 show several embodiments of the luminaire 100 having multiple second, small chambers 120. For example, the second chambers 120 may be placed on alternating sides of the first chamber 110 (as in FIG. 13), all on the same side of the first chamber 110 (as in FIG. 14), or on opposite ends of the first chamber 110 (as in FIG. 15). It should be appreciated that other arrangements of the second chamber 120 are possible for adapting the size and shape of the luminaire 100 for different applications (e.g., mounting the luminaire 100 in very small or non-uniformly shaped spaces), for adapting the luminaire 100 to provide illumination in various directions, or to provide other aesthetic characteristics). In one embodiment, the luminaire 100 is configured to be modular, in that any number of second chambers 120 can be coupled to the first chamber 110 to build, for example, a fixture as small as a few centimeters in any dimension, or as large as a ceiling of a room.

In some embodiments, the light sources 130 include tunable white, RGB, and/or RGBWA lights. For instance, the light sources 130 may include 15 LEDs in three groups of five (each group contained within a different second chamber 120). Each group of LEDs may include an amber, green, blue, red and white LED, or other types, colors or numbers of LEDs. Other combinations of LEDs are possible to provide various colors and amounts of light output.

In accordance with each of the above-described embodiments, the sizes of the first chamber 110 and the second chamber 120 can be varied relative to one another. According to some embodiments, the first chamber 110 is a large chamber relative to the size of one or more second chambers 120 that are coupled to it. Further, where a second chamber and a third chamber, which each include one or more light sources, are coupled to the first chamber, the dimensions of the second chamber may vary from the dimensions of the third chamber.

In accordance with each of the above-described embodiments, one or more LED-based direct view luminaires 100 may be coupled to a controller over a network. The network provides a communication path between the controller and each luminaire. For example, several luminaires may be arranged to provide light across a large space. The luminaires may be controlled individually, in groups or all together by the controller, for example, to control the brightness and/or color of any one or more of the luminaires.

While several inventive embodiments have been described and illustrated herein, those of ordinary skill in the art will readily envision a variety of other means and/or structures for performing the function and/or obtaining the results and/or one or more of the advantages described herein, and each of such variations and/or modifications is deemed to be within the scope of the inventive embodiments described herein. More generally, those skilled in the art will readily appreciate that all parameters, dimensions, materials, and configurations described herein are meant to be exemplary and that the actual parameters, dimensions, materials, and/or configurations will depend upon the specific application or applications for which the inventive teachings is/are used. Those skilled in the art will recognize, or be able to ascertain using no more than routine experimentation, many equivalents to the specific inventive embodiments described herein. It is, therefore, to be understood that the foregoing embodiments are presented by way of example only and that, within the scope of the appended claims and equivalents thereto, inventive embodiments may be practiced otherwise than as specifically described and claimed. Inventive embodiments of the present disclosure are directed to each individual feature, system, article, material, kit, and/or method described herein. In addition, any combination of two or more such features, systems, articles, materials, kits, and/or methods, if such features, systems, articles, materials, kits, and/or methods are not mutually inconsistent, is included within the inventive scope of the present disclosure.

All definitions, as defined and used herein, should be understood to control over dictionary definitions, definitions in documents incorporated by reference, and/or ordinary meanings of the defined terms.

The indefinite articles "a" and "an," as used herein in the specification and in the claims, unless clearly indicated to the contrary, should be understood to mean "at least one."

The phrase "and/or," as used herein in the specification and in the claims, should be understood to mean "either or both" of the elements so conjoined, i.e., elements that are conjunctively present in some cases and disjunctively present in other cases. Multiple elements listed with "and/or" should be construed in the same fashion, i.e., "one or more" of the elements so conjoined. Other elements may optionally be present other than the elements specifically identified by the "and/or" clause, whether related or unrelated to those elements specifically identified.

As used herein in the specification and in the claims, the phrase "at least one," in reference to a list of one or more elements, should be understood to mean at least one element selected from any one or more of the elements in the list of elements, but not necessarily including at least one of each and every element specifically listed within the list of elements and not excluding any combinations of elements in the list of elements. This definition also allows that elements may optionally be present other than the elements specifically identified within the list of elements to which the phrase "at least one" refers, whether related or unrelated to those elements specifically identified.

It should also be understood that, unless clearly indicated to the contrary, in any methods claimed herein that include more than one step or act, the order of the steps or acts of the method is not necessarily limited to the order in which the steps or acts of the method are recited. Also, reference numerals appearing in the claims in parentheses, if any, are provided merely for convenience and should not be construed as limiting the claims in any way.

What is claimed is:

1. A luminaire, comprising:

a plurality of light sources configured to, in combination, generate a plurality of different colors of light;

a first chamber configured to mix the plurality of different colors of light;

at least one light exit surface comprising a light transmissive diffuser coupled to the first chamber and configured to further mix light emitted from the plurality of light sources such that said further mixed light is transmitted through said at least one light exit surface; and a second chamber containing at least one first light source of the plurality of light sources and having at least one first wall and a first opening in communication with the first chamber, the at least one first wall configured to prevent the light emitted from the at least one first light source from directly impinging upon the at least one light exit surface, and the first opening configured to permit the light emitted from the at least one first light source to travel through the first opening from the second chamber to the first chamber, wherein at least a portion of the light emitted from the at least one first light source impinges through said first opening directly on a first light reflecting surface, which is distinct from the at least light exit surface, of the first chamber at a point on the first light reflecting surface that is disposed at least half-way along a length of the first light reflecting surface, wherein the first chamber and the at least one light exit surface are configured together to mix the light emitted from the plurality of light sources such that all light exiting the at least one light exit surface is substantially uniform in at least one of brightness or color.

2. The luminaire of claim 1, wherein the at least one light exit surface includes at least one directly viewable surface.

3. The luminaire of claim 1, wherein the second chamber is configured to mix the light emitted from the plurality of light sources.

4. The luminaire of claim 1, wherein the first light reflecting surface includes a reflective diffusive surface.

5. The luminaire of claim 1, wherein the first light reflecting surface is configured to reflect the at least a portion of the light emitted from the at least one first light source toward the at least one light exit surface.

6. The luminaire of claim 5, wherein the second chamber includes at least one second light reflecting surface.

7. The luminaire of claim 6, wherein the portion of the light emitted from the at least one first light source is a first portion of light, and wherein the at least one second light reflecting surface is configured to reflect at least a second portion of the light emitted from the at least one first light source that is different than the first portion toward the first light reflecting surface.

8. The luminaire of claim 7, wherein the first light reflecting surface includes an incidental light reflection point thereupon, and wherein the at least one second light reflecting surface is further configured to reflect the second portion of the light toward the incidental light reflection point such that the first portion of light and second portion of the light emitted from the at least one first light source are both reflected by the first light reflecting surface toward the at least one light exit surface in a same direction from the incidental light reflection point.

9. The luminaire of claim 1, further comprising at least one of a lens, a prism, a specular reflector, and a light diffuser disposed in the opening.

10. The luminaire of claim 1, further comprising a transmissive light diffuser disposed within the first chamber between the opening and the at least one light exit surface.

11. The luminaire of claim 1, wherein the at least one first light source is a first plurality of light sources, and wherein the luminaire further comprises a third chamber in light communication with the first chamber and containing a second plurality of light sources.

12. The luminaire of claim 11, wherein the first plurality of light sources is configured to generate a first set of colors of light and the second plurality of light sources is configured to generate a second set of colors of light that is different than the first set of colors such that a combination of the first set of colors and the second set of colors provides the plurality of different colors of light.

13. The luminaire of claim 12, wherein the first set of colors of light is a first single color of light, and wherein the second set of colors of light is a second single color of light.

14. The luminaire of claim 1, wherein the at least one first light source is a first plurality of light sources, and wherein the luminaire further comprises a first multi-channel lighting unit including the first plurality of light sources, a second multi-channel lighting unit including a second plurality of light sources, and a third chamber in light communication with the first chamber and containing the second multi-channel lighting unit.

15. The luminaire of claim 1, wherein the point directs the at least a portion of the light emitted from the at least one first light source in a direction that is toward said at least one light exit surface.

16. The luminaire of claim 15, further comprising:

a third chamber, different from the second chamber, containing at least one second light source of the plurality of light sources and having at least one second wall and a second opening in communication with the first chamber, the at least one second wall configured to prevent the light emitted from the at least one second light source from directly impinging upon the at least one light exit surface, and the second opening configured to permit the light emitted from the at least one second light source to travel through the second opening from the third chamber to the first chamber, wherein at least a portion of the light emitted from the at least one second light source impinges through said second opening directly on a second light reflecting surface, which is distinct from the at least one light exit surface, of the first chamber that is different from the first light reflecting surface such that the second light reflecting surface directs the at least a portion of the light emitted from the at least one second light source in a direction that is toward said at least one light exit surface.

17. The luminaire of claim 16, wherein the at least a portion of the light emitted from the at least one second light source impinges through said second opening directly on the second light reflecting surface at a point on the second light reflecting surface that is disposed at least half-way along a length of the second light reflecting surface.

18. The luminaire of claim 16, wherein all light exiting the at least one light exit surface is substantially uniform in brightness at the light exit surface.

19. The luminaire of claim 1, wherein all light exiting the at least one light exit surface is substantially uniform in brightness at the light exit surface.

* * * * *